United States Patent [19]

Barkan

[11] 4,156,803

[45] May 29, 1979

[54] SIMPLE DEVICE FOR RAPID DAMPING OF FLYWHEEL OSCILLATIONS IN A STORED-ENERGY OPERATING DEVICE

[75] Inventor: Philip Barkan, Stanford, Calif.

[73] Assignee: General Electric Company, Philadelphia, Pa.

[21] Appl. No.: 900,382

[22] Filed: Apr. 26, 1978

[51] Int. Cl.[2] ..... H01H 3/02

[52] U.S. Cl. ..... 200/153 SC; 188/1 B; 188/85

[58] Field of Search ..... 200/153 SC; 188/85, 188/1 B

[56] References Cited

U.S. PATENT DOCUMENTS

| | | | |
|---|---|---|---|
| 2,829,737 | 4/1958 | Favre | 200/153 SC |
| 2,909,629 | 10/1959 | McCloud | 200/153 SC |
| 2,972,259 | 2/1961 | Favre | 200/153 SC |
| 4,019,008 | 4/1977 | Kohler | 200/153 SC |

*Primary Examiner*—Steven L. Stephan
*Attorney, Agent, or Firm*—William Freedman; Carl L. Silverman

[57] ABSTRACT

An operating device for an electric circuit breaker includes a closing spring and a rotatable spring-controller mounted for rotation between first and second dead center positions with respect to the spring. The spring is charged by transmitting rotational forces to the spring-controller. One end of a connecting link is pivotally connected to a point on the spring-controller which is eccentric with respect to the center of rotation of the spring-controller. Another end of the connecting link is connected to an operating mechanism of the circuit breaker. Circuit breaker closing is effected by allowing the spring to quickly discharge after a charging operation. Damping means is provided for imposing a damping load on the spring-controller substantially only after it has performed its useful work and is undergoing subsequent oscillations. The damping means causes the duration of the oscillations to be substantially reduced so that the spring-controller is rapidly brought to rest. In one embodiment, the damping means comprises a braking member coupled to the connecting link. In this embodiment, the braking member includes a L-shaped brake support member a portion of which is connected to the spring-controller at the pivot end of the connecting link. Another portion of the brake support member includes a brake shoe mounted thereon. The damping load is automatically exerted by the brake shoe near the end of the spring discharging stroke without the need to transmit forces to any stationary support structure.

13 Claims, 9 Drawing Figures

SIMPLE DEVICE FOR RAPID DAMPING OF FLYWHEEL OSCILLATIONS IN A STORED-ENERGY OPERATING DEVICE

BACKGROUND OF THE INVENTION

This invention relates to a stored-energy operating device, and more particularly to such a device which includes means for damping of flywheel oscillation.

The invention is more specifically concerned with improvements in the general type of stored-energy operating device disclosed in U.S. Pat. Nos. 2,829,737—Favre and 2,909,629—McCloud. The operating devices disclosed in these patents each comprise a heavy spring which is charged by the action of a small electric motor rotating a spring-controller, or flywheel, into a dead-center position, corresponding to the maximum compression of the spring. Rotation of the spring-controller is continued until it reaches a predetermined position, slightly past dead center, where it is held by suitable releasable stop means. When the stop means is released, the heavy spring, which had been charged, quickly discharges, and this discharging action is utilized to produce closing of the circuit breaker.

To prevent damage to several parts of the device when the spring-controller is driven against the above-described stop after charging of the spring, a releasable coupling must be provided between the motor and the spring-controller. In a preferred operating device, the releasable coupling takes the form of a pawl and abutment drive such as the one described in copending application of Barkan, Ser. No. 702,328, filed July 2, 1976, entitled "Stored-Energy Operating Device for an Electric Circuit Breaker". This application is assigned to the assignee of the present application and is hereby incorporated by reference in the present application. In this preferred operating device, after the spring has been fully charged and just prior to the instant that the stop is encountered by the spring-controller, the pawl is released from the cooperating abutment, thus uncoupling the motor from the spring-controller. At approximately the same time, the motor is deenergized and allowed to coast to a halt without interference to the stop.

In the type of stored-energy device described above, the spring, upon discharging to close the circuit breaker, drives the spring-controller in a forward direction into a second dead-center position with respect to the spring which is angularly spaced 180° from the first dead-center position. Any excess energy remaining after this operation carries the spring-controller, or flywheel, in a forward direction past the second dead-center position, thus partially recharging the spring. Immediately after this partial recharging, the spring again discharges, driving the spring-controller in a reverse direction through the second dead-center to again partially recharge the spring. These oscillations of the spring-controller about the second dead-center continue at constant frequency, but with decreasing amplitude, until the excess energy is finally dissipated and the spring-controller comes to rest at the second dead-center position.

A problem presented by these oscillations is that it is necessary to immediately reenergize the charging motor in order to recharge the spring in the shortest possible time. It is therefore necessary that the oscillations be damped out by the time the motor-driven abutment reaches the pawl and begins transmitting recharging energy from the motor to the spring. Typically, a time of one to three seconds elapses between the release of the charged spring and the reengagement of the charging motor with the spring. Hence, it is necessary that the natural oscillations of the spring-controller be essentially damped out within one second. The inherent friction in the system is generally insufficient to damp these oscillations within such a short time. This is due to the fact that the inherent friction in the system is generally low in order to permit efficient use of the closing spring energy. My previously mentioned copending patent application suggested minimizing this problem by employing a continuously acting damper brake (see FIG. 4 of my copending application). However, although this is a solution to the oscillation problem, the use of such continuous damping adversely affects mechanism life, energy requirements and the torque magnitude imposed on the driving motor.

Accordingly, it is a general object of my invention to provide damping means which is operable only during a predetermined portion of rotation of the spring-controller.

Another object of my invention is to provide such damping means in the form of a simple part which can be easily incorporated into a stored-energy operating device such as the one shown in my previously mentioned copending patent application.

Another object of my invention is to provide such damping means which is operable substantially only during that portion of rotation of the spring-controller for which the previously mentioned oscillations occur.

Another object of my invention is to provide such damping means operable substantially after the useful work of the closing spring has been accomplished so that no significant penalty in the operating efficiency of a stored-energy operating device results.

Another object of my invention is to provide such damping means whose operation does not substantially increase the peak torque required for charging the closing spring.

SUMMARY OF THE INVENTION

In one form of the present invention, I provide a stored-energy operating device for closing the operating mechanism of an electric circuit breaker. The device includes a spring and a rotatable spring-controller mounted for rotation between first and second angularly spaced dead-center positions with respect to the spring. Means is provided for transmitting charging forces to the spring in response to rotation of the spring-controller in a forward direction toward the first dead-center position. The spring acts to discharge and thereby further to rotate the spring-controller in the forward direction when the spring-controller has been rotated in a forward direction past the first dead-center position. Releasable stop means is provided for coacting with the spring-controller and blocking the further forward rotation of the spring-controller. The stop means is releasable to permit the spring to rapidly discharge and continue forward rotation of the spring-controller into the second dead-center position. Following the rapid discharge of the spring, the spring-controller oscillates about the second dead-center position. Connecting means are provided for connecting the spring-controller to the operating mechanism of the electric circuit breaker wherein rotation of the spring-controller in a forward direction from the first dead-center position to the second dead-center position effects closing of the circuit breaker operating mechanism. Braking means is provided for imposing a load on the spring-controller during the oscillations wherein the duration of the oscillations is reduced. The braking means is automatically responsive to the rotation of the spring-controller and imposes the load on the spring-controller substantially only during a predetermined portion of rotation of the spring-controller which is less than a complete rotation of the spring-controller.

BRIEF DESCRIPTION OF THE DRAWINGS

In FIG. 4A, the positioning of the braking member near the end of the closing stroke is depicted. In FIG. 4B, the position of the braking member is shown with the spring-controller in second dead-center position, i.e., after discharge.

DETAILED DESCRIPTION OF THE INVENTION

Figure 1:
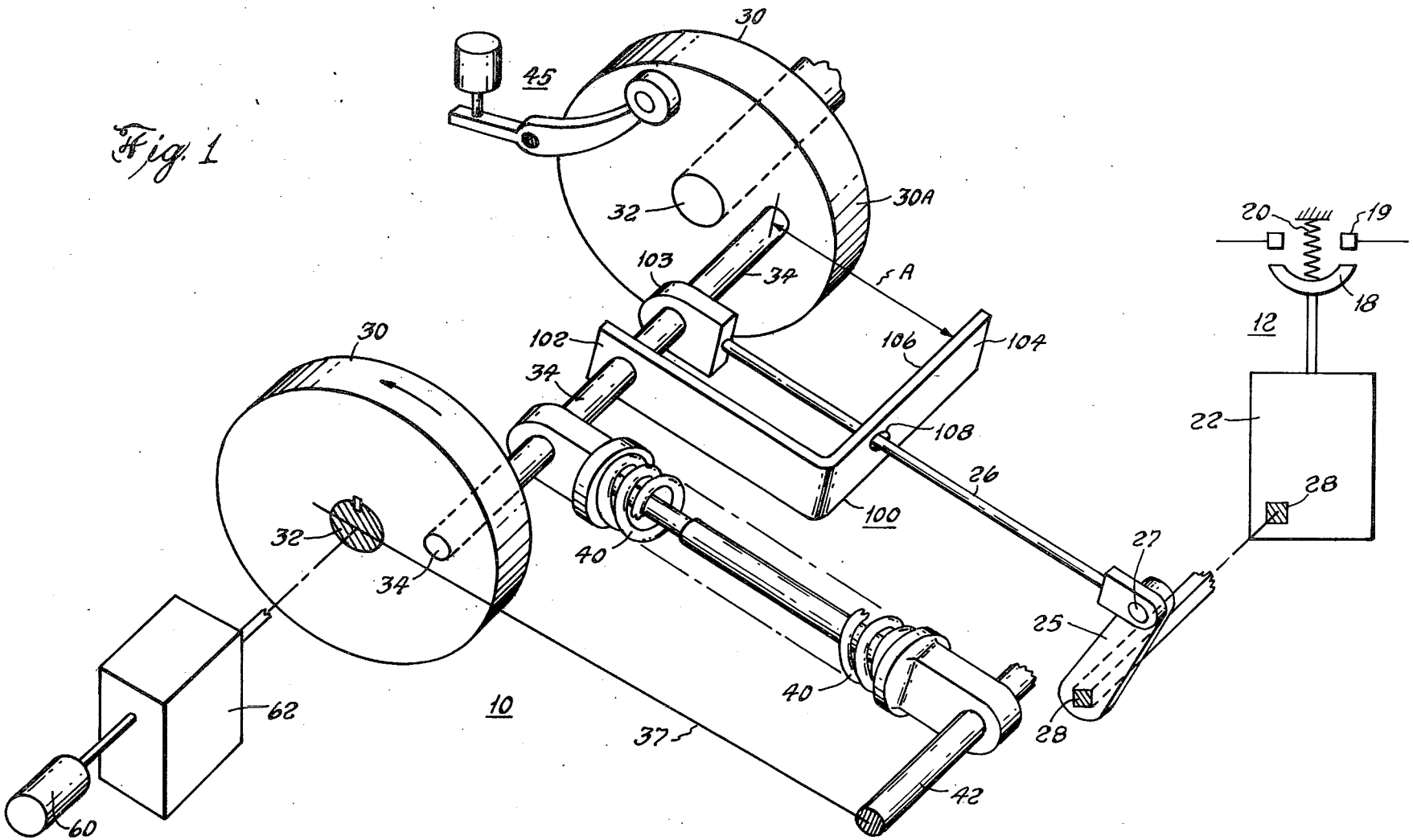
FIG. 1 is a perspective view of one form of the stored-energy operating device to which the present invention relates. In this Fig., the spring is fully charged, the spring-controller is in a position slightly forward of of first dead-center, and the circuit breaker is shown in an open position. This Fig., is similar to FIG. 1 of my copending application, Ser. No. 702,328, filed July 2, 1976, but several elements therein have been shown schematically.

Referring initially to FIG. 1, a preferred stored-energy operating device employing one form of damping means of the present invention is generally designated 10. The operating device 10 is designed to close a conventional circuit breaker 12. The operating device 10 is substantially the same as the one described in my copending patent application of Ser. No. 702,328, filed July 2, 1976, which has been incorporated by reference in the present application. FIG. 1 is similar to FIG. 1 of my copending application. Wherever possible, I have continued to employ the reference numerals employed in my copending application.

In order to aid in the understanding of the present invention, the stored-energy operating device 10 and breaker 12 will first be generally described before describing the damping means of the present invention.

The circuit breaker 12 includes relatively movable contacts 18, 19 with contact 18 biased open by spring 20. Closing forces are transmitted to the contact 18 by a conventional operating mechanism 22 which is preferably trip-free. Operating force is supplied to this operating mechanism 22 through a crank 25 and a connecting link 26 which is pivotally connected to the crank at 27. Crank 25 is keyed to a rotatable shaft 28 having a fixed axis and suitably coupled to the mechanism 22. When crank 25 is rotated in a counterclockwise direction about the axis of shaft 28 from its position of FIG. 1 to its position of FIG. 2, the circuit breaker operating mechanism 22 acts to close the contacts 18, 19.

For driving connecting link 26 from its position of FIG. 1 to the left to produce the above-described operation, i.e., closing of the circuit breaker 12, the stored-energy operating device 10 is relied upon. This operating device 10 comprises a pair of coupled rotatable spring-controllers 30, also termed flywheels. The flywheels 30 are freely rotatable on a centrally located shaft 32. Each flywheel 30 includes a crank pin 34 fixed thereto at a point spaced radially from the axis of the shaft 32, i.e., eccentrically disposed. The connecting link 26 is pivotally connected to the eccentric crank pin 34. For purposes of convenience, the two flywheels 30 will sometimes be referred to in the singular, i.e., flywheel 30.

Cooperating with the flywheels 30 is a heavy compression spring 40 having one end pivotally connected to eccentric crank pin 34 and another end pivotally mounted on a stationary pivot 42. The flywheels, 30 have two different dead-center positions with respect to spring 40. In a first one of these dead-center positions, the axis of crank pin 34 is located between the axis of shaft 32 and the axis of pivot pin 42 and on a reference line 37 interconnecting these latter two axes. In a second one of these dead-center positions, the axis of crank pin 34 is located on the same reference line 37 but on the opposite side of the axis of shaft 32.

In FIG. 1, the parts are depicted in a position wherein the crank pin 34 has been driven in a counterclockwise, or forward, direction past the first dead-center position. Spring 40 is essentially fully charged and is biasing flywheel 30 in a counterclockwise direction but is blocked from discharging by a releasable stop means 45. This releasable stop 45 may take the form of the one described in my previously mentioned copending application.

Figure 2:
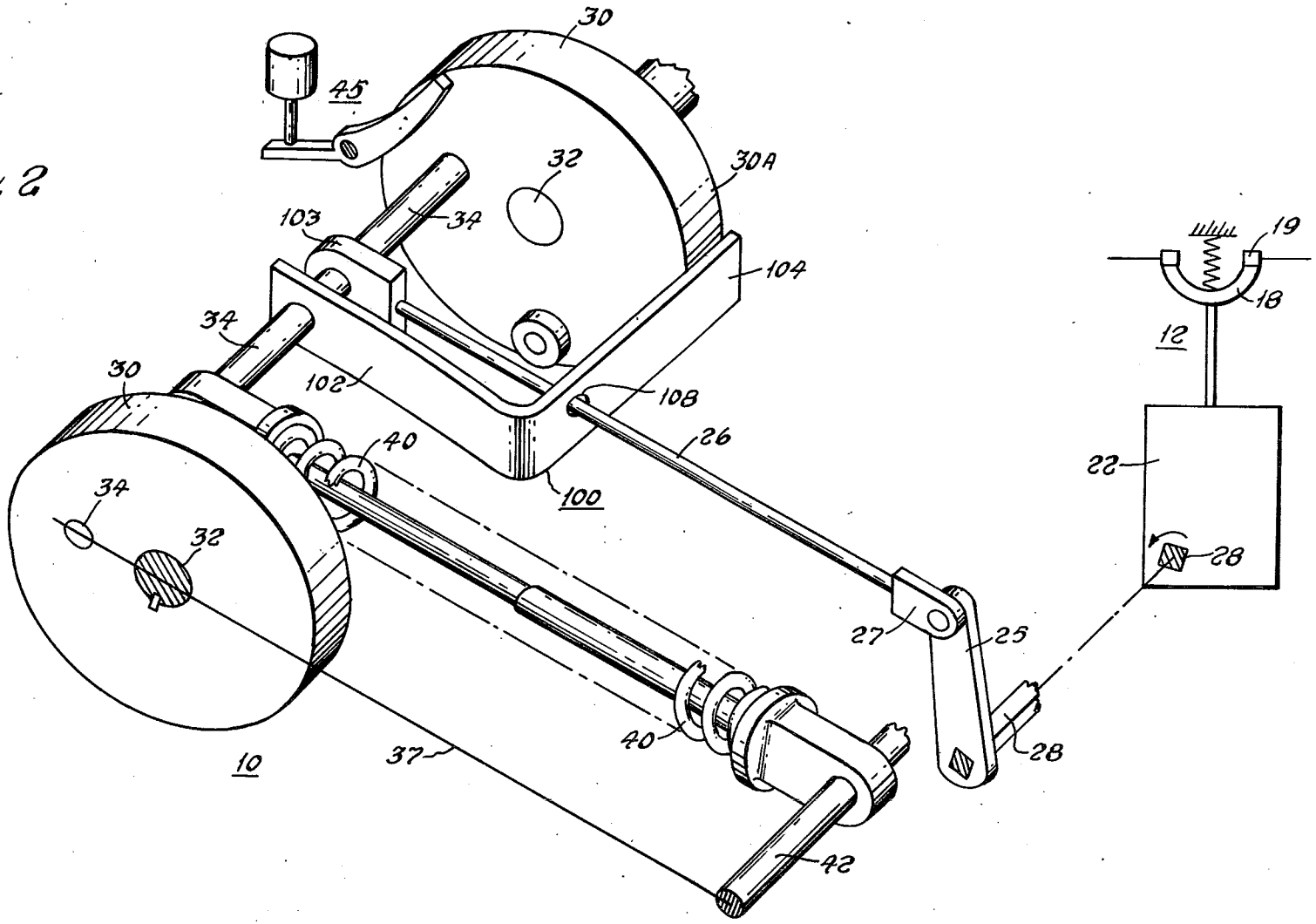
FIG. 2 is a perspective view, similar to FIG. 1, but with the spring fully discharged, the spring-controller in its second dead-center position, and the circuit breaker in a closed position.

When stop 45 is released, main compression spring 40 is free to drive flywheel 30 in a counterclockwise direction from its position of FIG. 1 into its second dead-center position, which is shown in FIG. 2. This counterclockwise motion of flywheel 30 is transmitted to connecting link 26 through eccentric crank pin 34 and acts to drive link 26 through a predetermined translation effecting a circuit-breaker closing stroke, i.e., closing the operating mechanism 22 of the circuit breaker 12.

Compression spring 40 is recharged after the above-described discharge by driving flywheel 30 in a counter-clockwise, or forward, direction from its position of FIG. 2 into its position of FIG. 1. During this recharging motion, the connecting link 26 moves to the right from its position of FIG. 2 into its position of FIG. 1, but, through suitable design means, this motion of link 26 has no effect on the operating-closing mechanism 22 of the circuit breaker, as noted hereinabove. One such suitable design means employs the use of a slotted link and is more fully discussed in my copending patent application, Ser. No. 703,328, filed July 8, 1976, which is hereby incorporated by reference in the present application. For driving flywheel 30 through this recharging motion, motor means 60 and releasable coupling means 62 are provided, each of which is simply depicted in block form and more fully discussed in my copending patent application of Ser. No. 702,328, filed July 2, 1976.

The counterclockwise spring-charging motion of the flywheel 30 is continued for slightly more than 180° until the flywheel is returned to its position of FIG. 1, where it is blocked by the stop 45. Such counterclockwise motion of the flywheel charges spring 40 until the previously-described first dead-center position is reached. Thereafter, flywheel 30 passes in a counterclockwise direction slightly beyond this dead-center position (typically about 10°) and into its overcenter, blocked position of FIG. 1.

One simple form of damping means of the present invention will now be generally described. In FIGS. 1 and 2, a simple L-shaped braking member 100 is shown in coupled relation to the connecting link 26. The braking member 100 has one end 102 pivotally connected to eccentric crank pin 34, e.g., through a bolted connection (not shown) to a pivot block 103 which also supports the pivot end of the connecting link 26. Another portion 104 of the braking member 100 is coupled to the connecting link 26. In the present embodiment, for simple assembly, the coupling is in the form of an aperture 108 in the end 104 through which the connecting link 26 is slidably disposed. (Note that device operation does not always require this sliding arrangement). The end 104 includes a braking surface 106. In the fully charged circuit breaker open position of FIG. 1, the braking surface 106 does not contact the edge surface 30A of the spring-controller 30. However, in the second dead-center position of FIG. 2, the braking surface 106 imposes a damping load on the edge surface 30A of the spring-controller 30.

Figure 3:
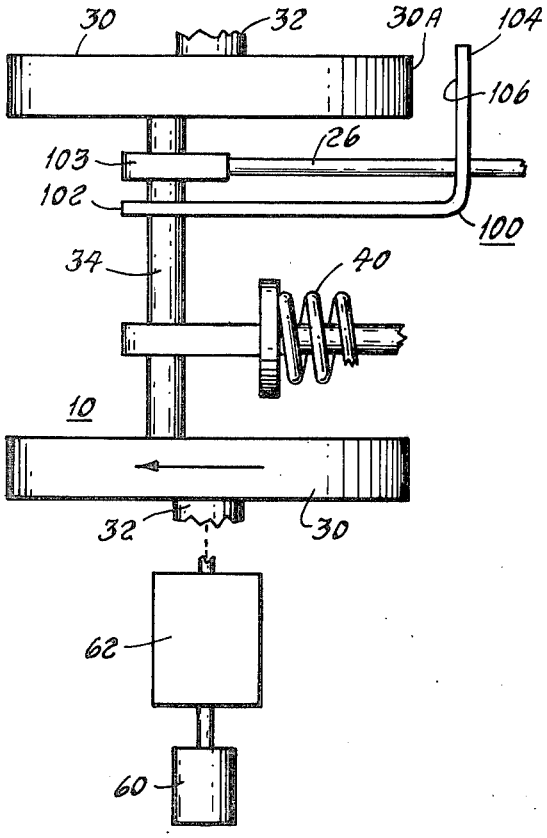
FIG. 3 is a simplified plan view of a portion of the operating device of FIGS. 1 and 2 showing more clearly the relative positioning of the elements included therein. In this Fig., the spring-controller is in a position other than second dead-center position.
Figure 4A:
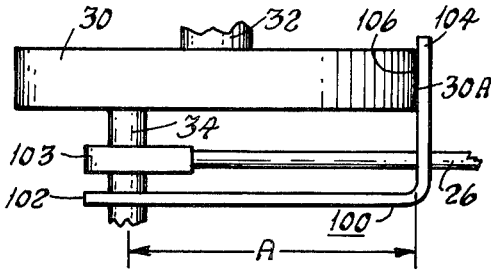
FIGS. 4A, 4B are simplified plan views, taken as in FIG. 3, showing the operation of one form of braking member of the present invention.
Figure 4B:
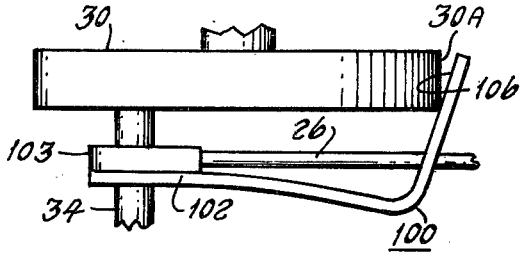

Referring now to FIG. 3, a simplified plan view of the stored-energy operating device 10 is shown. In this Fig., the operating device 10 is shown with the braking member 100 in an unengaged position. Referring now to FIGS. 3, 4A, 4B, the principle of operation of the braking member 100 will be generally described. As the flywheel 30 rotates about its center axis, the distance between the braking surface 106 and the flywheel edge 30A varies continuously. It is to be appreciated, however, that this distance is a function of the position of the flywheel 30, i.e., eccentric crank pin 34, with respect to the dead center position of the connecting link 26 to which the braking member 100 is coupled. Hence, through each complete rotation of the flywheel 30, this distance varies from a predetermined maximum to a predetermined minimum (or even negative value). A negative value is one in which the braking surface 106 would normally be moved inwardly past the flywheel edge 30A if the edge were not present. Thus, a negative value causes the braking surface 106 to deform and thereby to impose a load on the edge 30A of the flywheel 30. This imposed load functions to damp further rotation of the flywheel. In the present invention, the above-described principle is employed to provide damping of the rotation of the flywheel 30 for a predetermined portion of rotation thereof where the undesirable oscillations would otherwise occur. More particularly, the damping force is provided substantially only around the second dead-center position after closing of the circuit breaker 12 and discharge of the spring 40 (see FIG. 2).

Referring again to FIG. 3, the position of the braking surface 106 with respect to the edge 30A of the flywheel 30 is shown when the flywheel 30 is in an intermediate position where oscillations do not generally occur, i.e., during a closing stroke or during the subsequent recharging stroke. In this Fig., the braking member 100 is not damping further rotation of the flywheel 30 so no unnecessary resistance to rotation is provided. However, as shown in FIG. 4A, near the end of the circuit breaker closing stroke, the position of the eccentric crank pin 34 causes the braking surface 106 to engage the edge 30A of the flywheel 30 and begins to impose a damping load to the edge 30A. As the flywheel 30 rotates further to its second dead-center position, the end 102 of brake member 100 is forced against pivot block 103 firmly, and the braking surface 106 bends and applies maximum braking force to the edge 30A of the flywheel, as shown in FIG. 4B. If the flywheel 30 continues to rotate beyond the second dead-center position of FIG. 4B, the braking force decreases, and the positions of FIG. 4A and FIG. 3 will reappear. This latter feature will be discussed more fully later in connection with the subsequent recharging operation. In view of the foregoing, it is apparent that the braking member 100 of the present invention applies a damping force substantially only at a predetermined portion of rotation of the flywheel 30 for which the undesirable oscillations would otherwise be a problem, i.e., around the second dead-center position shown in FIG. 2. Also to be noted is that the damping means is automatically mechanically responsive to the rotation of the flywheel, requiring no additional monitoring equipment.

In order to provide the desired angle of engagement, i.e., damping angle, a dimension A of the braking member 100, representing the distance between its nondeformed braking surface 106 and its pivot connection at the eccentric crank 34 is carefully chosen with due regard to the system dimensions. More particularly, referring to the second dead-center position of FIGS. 2 and 4B, the dimension A, if smaller than the distance between the pivot connection at the eccentric crank 34 and the adjacent flywheel edge 30A, i.e., the edge adjacent the braking surface 106, results in a situation in which, for at least a portion of rotation of the flywheel, damping force is applied to the flywheel. The precise angle of the engagement between the braking surface 106 and the edge 30A of the flywheel 30 is determined by the degree to which the distance between the adjacent flywheel edge 30A and pivot connection at crank 34 exceeds the dimension A. Typically, I have found it to be preferable to apply the damping force in a portion of the rotation of the flywheel which comprises about 30 degrees on each side of the second dead-center position. The magnitude of the damping force is controlled by suitable choice of the dimension A and the selection of the material from which the braking surface 106 and braking member 100 are formed. Where the braking member 100 is an L-shaped body of sheet metal and the flywheel 30 is steel, the thickness of the braking member can be chosen to provide the desired damping force.

Figure 5:
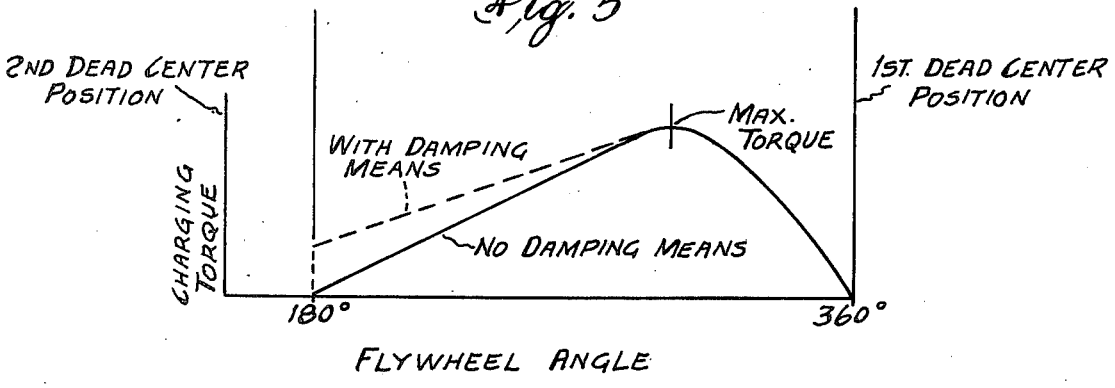
FIG. 5 is a graph showing the effect of the damping means of the present invention on the torque required for spring charging.

Referring now to FIG. 5, the effect of the damping means of the present invention on the torque required for spring charging will now be discussed. When the motor engages the flywheel to initiate the recharging of the heavy spring, the spring is at rest at the second dead-center position. Thus, the motor must overcome the damping force in addition to the force exerted by the substantially discharged spring. However, the substantially discharged spring exerts only a relatively light force. In addition, near the second dead-center position, the torque arm is small so only a small value of motor torque is required to initiate spring recharging. As the flywheel rotates toward the charged first dead-center position, the now partially charged spring exerts an increased force against further flywheel rotation. In addition, this further rotation lengthens the torque arm so that a significant load is imposed upon the charging motor. However, at this point when the more significant load is imposed upon the charging motor, the damping force drops out so that the peak torque required by the charging motor is unchanged as compared to the peak torque required by a charging motor in a system having no damping means.

Figure 6A:
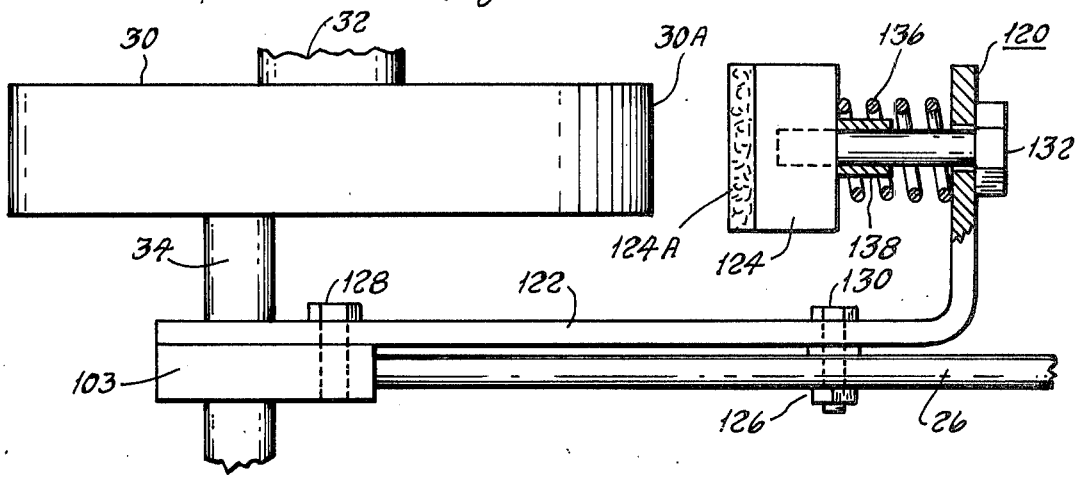
FIGS. 6A, 6B are plan views showing another form of braking member suitable for use in the present invention.
Figure 6B:
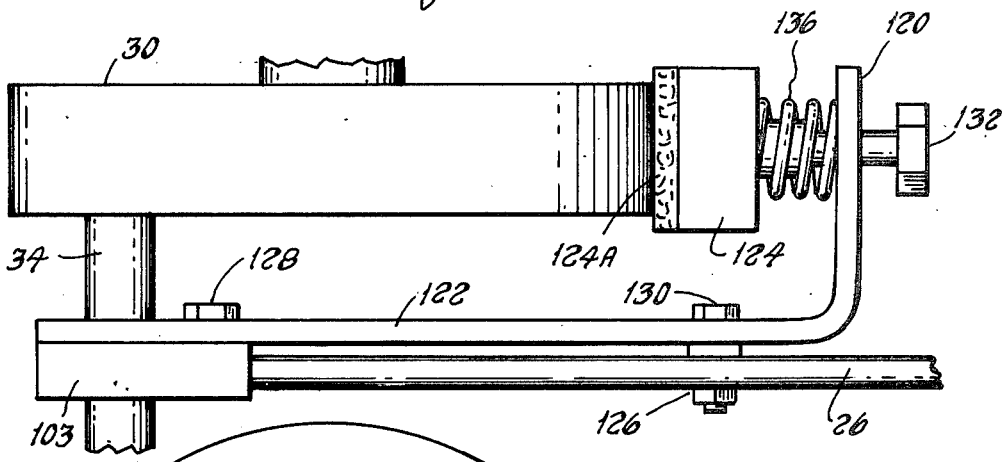
Figure 7:
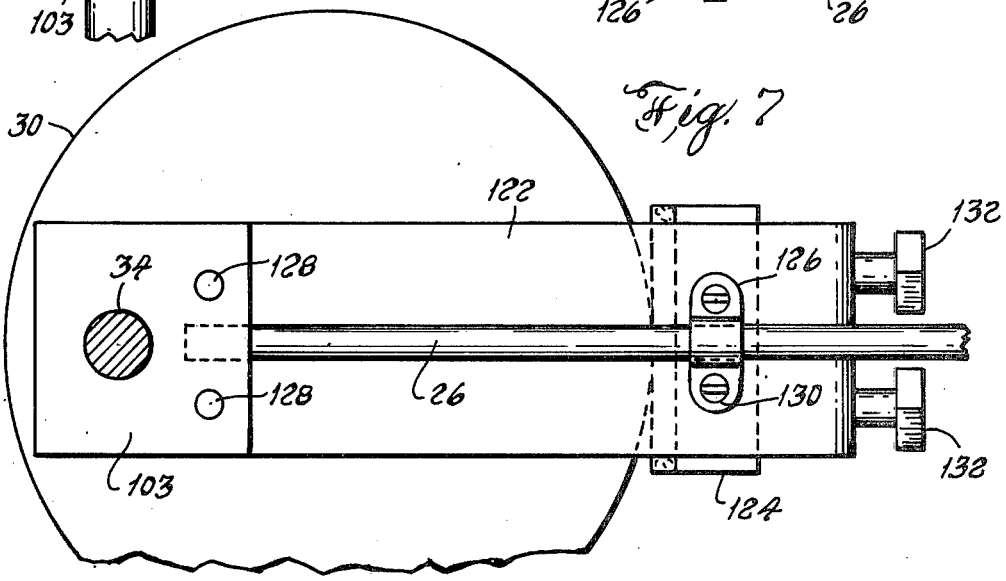
FIG. 7 is a front view showing the braking member of FIGS. 6A, 6B.

For applications where improved durability is required, it is preferable to modify the previously described simple braking member 100. One preferred braking member 120 is generally shown in plan view in FIGS. 6A, 6B and more specifically in FIG. 7. The braking member 120 includes an L-shaped supporting member 122 to which a brake shoe 124 is coupled. The supporting member 122 is pivotally connected to the eccentric crank pin 34 through the pivot connection block 103. In FIGS. 6A, 6B, the supporting member 122 is firmly coupled to the connecting link 26 through sleeve clamp 126. FIG. 6A shows the brake shoe 124 in an unengaged position with respect to the flywheel 30 while FIG. 6B shows the brake shoe 124 in an engaged position wherein further rotation of the flywheel 30 is damped. The L-shaped supporting member 122 is connected to the pivot block 103 through bolts/nuts 128. The connecting link clamp 126 (shown in FIGS. 6A, 6B as a firm clamp and in FIG. 7 as a sliding clamp) is connected to the supporting member 122 by bolts/nuts 130. The brake shoe 124 includes a brake lining 124A and is resiliently coupled to the supporting member 122 by bolts 132. Springs 136 are disposed around the bolts 132 between the supporting member 122 and the brake shoe 124 and bias the brake shoe 124 toward the flywheel 30. Between the bolts 132 and the springs 136 is a spacer bushing 138. In the operation of the braking member 120, the springs 136 function to provide a controlled amount of braking force when the flywheel is engaged with the brake shoe. Also, the springs 136 permit the compliance required to accommodate the interference (negative clearance) as the brake shoe is pulled in to greater contact as the second dead-center position is approached. The presence of the spacer bushing 136 prevents overcompression of the springs 136.

It is to be noted that the damping means of the present invention as hereinbefore described are in the form of a simple part(s) which can be easily incorporated into a stored energy operating device.

Although the damping means of the present invention has been described in connection with specific embodiments, variations thereof are available. For example, the damping means is suitable for use in stored energy operating devices other than the one described in my copending patent applications. Also, although it is preferable that one end of the braking member be coupled to the connecting link, it is apparent that it is only necessary for proper operation that the nonpivoted end of the braking member be guided so as to permit it to perform reciprocating radial motion with respect to the center of rotation of the flywheel. Thus, the braking member need not be coupled to the connecting link. For example, the braking member could be coupled to the closing spring instead of the connecting member. Also, although the preferred stored-energy operating device includes a pair of coupled rotating flywheels, only one such flywheel is necessary. It is also to be noted that such flywheels need not be circular in configuration. Indeed, for some applications, a rotatable noncircular configuration may be preferable. In such applications, the noncircular configuration may be employed to provide a particular damping force characteristic.

While I have illustrated preferred embodiments of my invention, many modifications will occur to those skilled in the art and I therefore wish to have it understood that I intend in the appended claims to cover all such modifications as fall within the true spirit and scope of my invention.

What I claim as new and desire to secure by Letters Patent of the United States is:

1. In a stored-energy operating device for closing the operating mechanism of an electric circuit breaker, comprising, (a) a spring, (b) a rotatable spring-controller mounted for rotation between first and second angularly-spaced dead-center positions with respect to said spring, (c) means for transmitting charging forces to said spring in response to rotation of said spring-controller in a forward direction toward said first dead-center position, (d) said spring acting to discharge and thereby further to rotate said spring-controller in a forward direction when said spring-controller has been rotated in a forward direction past said first dead-center position, (e) releasable stop means coacting with said spring-controller for blocking said further forward rotation of said spring-controller, said stop means being releasable to permit said spring to rapidly discharge and continue forward rotation of said spring-controller into said second dead-center position, (f) said spring-controller oscillating about said second dead-center position immediately following said rapid discharge of said spring, (g) connecting means connecting said spring-controller to said operating mechanism of said electric circuit breaker wherein rotation of said spring-controller in a forward direction from said first dead center position to said second dead center position effects closing of said breaker operating mechanism, and (h) braking means for imposing a load on said spring-controller during said oscillations wherein the duration of said oscillations is reduced, said braking means being automatically responsive to the rotation of said spring controller for imposing said load on said spring-controller substantially only during a predetermined portion of rotation of said spring-controller which is less than a complete rotation of said spring-controller.

2. A device in accordance with claim 1 which includes means for forwardly rotating said spring-controller from said second to said first dead-center position thereby charging said spring.

3. A device in accordance with claim 1 wherein (a) said connecting means of (g) comprises a connecting link, one end of said link being pivotally connected to a crank pin which is eccentrically fixed to said spring-controller, an opposing end of said link being connected to said operating mechanism of said electric circuit breaker, wherein rotation of said spring-controller in a forward direction from said first dead-center position to said second dead-center position causes a predetermined translation of said opposing end of said link which effects said closing of said operating mechanism, and (b) said braking means of (h) comprises a braking member, one portion of which is pivotally connected to said crank pin, a second portion of said braking member including a braking surface for imposing said load on an edge surface of said spring-controller, said second portion being disposed so as to perform reciprocating radial motion with respect to the center of rotation of said spring-controller, a predetermined dimension separating said braking surface of said second portion from said pivot connection at said one portion so that said braking surface of said braking member imposes said load on said edge surface of said spring-controller substantially only during said predetermined portion of rotation.

4. A device in accordance with claim 3 which includes coupling means coupling said braking member to said connecting link wherein said second portion performs said reciprocating radial motion with respect to the center of rotation of said spring-controller.

5. A device in accordance with claim 4 in which said braking member is substantially L-shaped with said one portion corresponding to a first member of said L and said second portion corresponding to a second member of said L, said second member of said L including said braking surface, said first member of said L being pivotally connected to said crank pin.

6. A device in accordance with claim 5 in which said coupling means comprises an aperture in said second member of said L through which said connecting link is translatably disposed.

7. A device in accordance with claim 4 in which said braking member comprises a brake support member and a brake shoe mounted thereon with said braking surface comprising a surface of said brake shoe.

8. A device in accordance with claim 7 in which said brake support member is substantially L-shaped with said one portion corresponding to a first member to said L and with said second portion corresponding to a second member of said L, said first member of said L being pivotally connected to said crank pin.

9. A device in accordance with claim 8 in which said brake shoe is connected to said second member of said L through spring connection means.

10. A device in accordance with claim 9 in which said coupling means comprises a sleeve member slidably containing said connecting link, said sleeve member being secured to said first member of said L.

11. A device in accordance with claim 7 in which includes motor means for forwardly rotating said spring-controller from said second to said first dead-center position thereby charging said spring and wherein said braking means does not substantially increase the peak torque required by said motor means during said charging.

12. A device in accordance with claim 1 in which said predetermined portion of rotation of said spring-controller comprises about 30 degrees on each side of said second dead-center position.

13. A device in accordance with claim 1 in which said braking means of (h) comprises:

a brake assembly including a deformable member, one portion of said assembly being pivotally connected to a crank pin which is eccentrically fixed to said spring-controller, a second portion of said assembly being constrained in a manner wherein it performs reciprocating motion with respect to the center of rotation of said spring-controller, said reciprocating motion including a radial component, said second portion of said assembly including said deformable member with said deformable member extending across an edge of said spring-controller wherein at said second dead-center position a predetermined interference exists between said deformable member and said edge of said spring-controller causing said deformable member to deform, thereby developing a predetermined force which is exerted against said edge of said spring-controller.

* * * * *